United States Patent [19]

Alexander

[11] 4,309,931

[45] Jan. 12, 1982

[54] ARTICULATED SAW

[76] Inventor: Carl J. Alexander, Box 18, Moore Park, Mich. 49093

[21] Appl. No.: 59,985

[22] Filed: Jul. 23, 1979

Related U.S. Application Data

[63] Continuation-in-part of Ser. No. 944,202, Sep. 19, 1978, abandoned, which is a continuation of Ser. No. 697,978, Jun. 21, 1976, abandoned.

[51] Int. Cl.[3] ..... B27B 17/02

[52] U.S. Cl. ..... 83/832; 83/830

[58] Field of Search ..... 83/830–834; 30/386, 387

[56] References Cited

U.S. PATENT DOCUMENTS

| | | | |
|---|---|---|---|
| 226,774 | 4/1880 | Nunan | 83/830 X |
| 285,651 | 9/1883 | Newlove | 30/387 |
| 1,779,083 | 10/1930 | Bens | 83/832 |
| 2,481,835 | 9/1949 | Gannon | 83/830 X |
| 2,488,343 | 11/1949 | Standal | 83/832 X |
| 3,228,437 | 1/1966 | Wezel | 83/830 |

FOREIGN PATENT DOCUMENTS

| | | | |
|---|---|---|---|
| 675997 | 5/1939 | Fed. Rep. of Germany | 83/830 |

*Primary Examiner*—James M. Meister

*Attorney, Agent, or Firm*—Dressler, Goldsmith, Shore, Sutker & Milnamow, Ltd.

[57] ABSTRACT

A power driven saw is provided with an endless array of planar cutting members hingedly interconnected to form an articulated saw blade. The cutting members are disposed about the periphery of an elongated saw blade support structure to present a circumferential band of cutting teeth.

11 Claims, 22 Drawing Figures

210
218
216
250
217
212
220
214
238
248
213

266
216
217
280
282
250
256
254
252 d
D

ARTICULATED SAW

CROSS REFERENCES TO RELATED APPLICATIONS

This application is a continuation-in-part of my copending application Ser. No. 944,202 entitled "Articulated Saw," which was filed Sept. 19, 1978, now abandoned, as a continuation of my application Ser. No. 697,978, filed June 21, 1976, now abandoned.

BACKGROUND OF THE INVENTION

The present invention is related to saws, and more particularly, to power driven saws which utilize an endless array of cutting teeth.

The use of chain saws in many applications is not without disadvantages. Compared to carpenter's handsaws and power band saws, the kerf of a chain saw is much wider. The wider kerf is undesirable for two reasons: (1) the wider kerf removes more material from the cut than a narrower kerf would and thus, converts a larger portion of the material being cut to waste, and (2) removal of more material from the cut requires more power input for cutting.

Saws, such as a hand saw or those employing reciprocating saw blade mechanisms, have the disadvantage of inefficiency associated with the return stroke.

The band saw has the advantage over the reciprocating saw in that return stroke efficiency is eliminated as the band saw operates to continuously cut. Further, the band saw has a much narrower kerf as compared to the chain saw. However, the use of a band saw also has disadvantages. First, the band saw has a throat limitation which limits the size of the material being cut. And, of course, the throat limitation of a band saw limits the effectiveness of the band saw if it were to be used in some portable embodiment. Secondly, a band saw blade is constantly undergoing bending and flexing as it is engaged by the drive and idler wheels. Since the band saw blade must be able to withstand the flexing and bending, the blade is limited to certain suitable flexible materials and to suitable hardness tempers.

The saw of the present invention substantially mitigates or eliminates the disadvantages associated with the other types of currently employed saw devices and incorporates many of the desirable features of the chain saw and band saws.

SUMMARY OF THE INVENTION

This invention contemplates a power-driven articulated saw blade mounted on a frame and saw blade support structure to provide a saw having the general shape and portability of a conventional portable chain saw. The articulated blade is substantially planar and comprises one or more rows of hingedly connected relatively thin planar cutting members. Each cutting member is substantially rectangular in shape, having a pair of opposed longitudinal margins and a pair of end margins. A plurality of cutting teeth is provided along one of the longitudinal margins.

In a preferred embodiment, the articulated blade comprises three adjacent rows of planar cutting members. Each cutting member of one of the two exterior rows is aligned with a cutting member in the other exterior row and is offset from side-by-side alignment with the cutting members of the middle row so that each middle cutting member is overlapped at each end on both sides by the cutting members in the two exterior rows. On each end, each middle row cutting member is rotatably connected to cutting members in each exterior row with a journalled connector means comprising a journal and a journal bearing. The middle row cutting members are deeper than the cutting members in the exterior rows thereby having the longitudinal margins projecting beyond those of the exterior cutting members. The projecting bottom longitudinal margins of the middle cutting members are disposed within a peripheral slot in a saw blade support and therein bear against a bearing surface provided on the blade support at the bottom of the slot. The bottoms of the cutting members of the two exterior rows bear against bearing surfaces on the saw blade support structure on either side of the slot. Thus, the entire articulated band of saw blade cutting members is supported to resist the cutting bearing forces and is supported to resist any lateral bending or twisting forces as well.

A notch is provided in the bottom of each of either the exterior row cutting members or the middle row cutting members for engaging a drive sprocket mounted at one end of the elongated blade support structure. The drive sprocket has a plurality of drive pins or rollers disposed at its periphery with each drive pin being substantially perpendicular to the plane of the row of cutting members adapted to drivingly engage the notches in the cutting members.

Numerous other advantages and features of the present invention will become readily apparent from the following detailed description of the invention and of embodiments thereof, from the claims and from the accompanying drawings in which each and every detail shown is fully and completely disclosed as a part of this specification.

BRIEF DESCRIPTION OF THE DRAWINGS

In the accompanying drawings forming part of the specification, and in which like numerals are used to designate like parts throughout the same.

DESCRIPTION OF PREFERRED EMBODIMENTS

Figure 1:
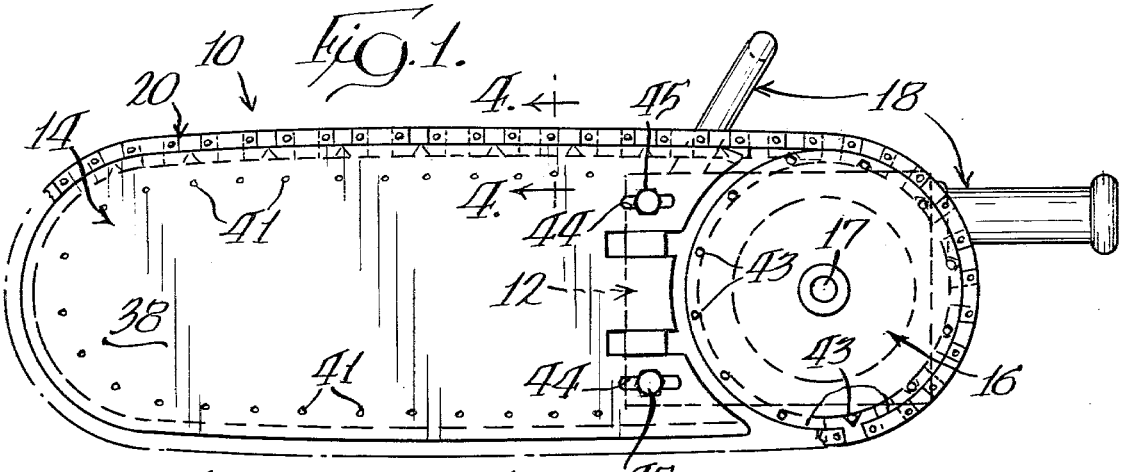
FIG. 1 is a side elevation view of one embodiment of the saw of this invention, partially broken away, to show interior detail.

While this invention is susceptible of embodiment in many different forms, there is shown in the drawings and will herein be described in detail preferred embodiments of the invention with modifications thereof, with the understanding that the present disclosure is to be considered as an exemplification of the principles of the invention and is not intended to limit the invention to the embodiments illustrated. The scope of the invention will be pointed out in the appended claims.

One embodiment of the saw of the present invention is generally designated by reference numeral 10 in FIG. 1. Saw frame 12 (hidden in FIG. 1 and shown in dashed line) is provided to mount saw blade support 14 and saw blade drive means 16. Connected to frame 12 are handles 18. The saw is portable and can be held by handles 18 for cutting at any angle.

Articulated saw blade 20 of this invention is disposed about the periphery of saw blade support 14 and engaged at one end of saw 10 by saw blade drive means 16 which, in turn, is driven via shaft 17 by suitable prime mover such as an electric motor, an internal combustion engine, or the like.

Figure 2:
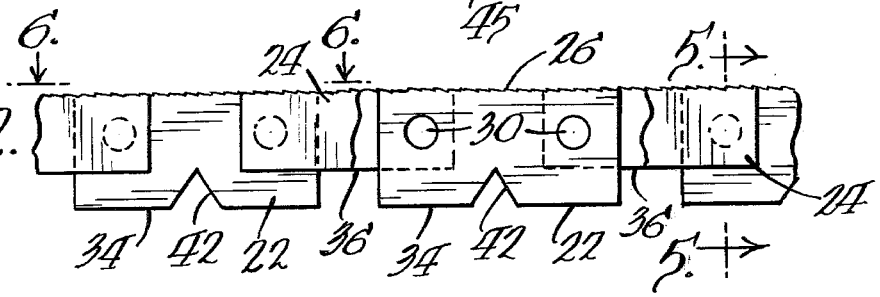
FIG. 2 is a side elevation of a portion of one embodiment of the articulated saw blade of this invention.

The side profile shape of articulated saw blade 20 is more clearly shown in FIG. 2. Planar middle cutting members 22 are disposed between exterior or outer rows of planar exterior cutting members 24. Both middle cutting members 22 and the exterior cutting members 24 are generally rectangular in shape. Each planar cutting member has two opposed longitudinal margins and two opposed end margins. A plurality of cutting teeth 26 are disposed along one longitudinal margin of each of the cutting members and are generally in the plane of the respective cutting member. Cutting teeth 26 of each cutting member together form a substantially continuous circumferential row of cutting teeth about the outer periphery of articulated saw blade 20 and have a positive rake.

Figure 3:
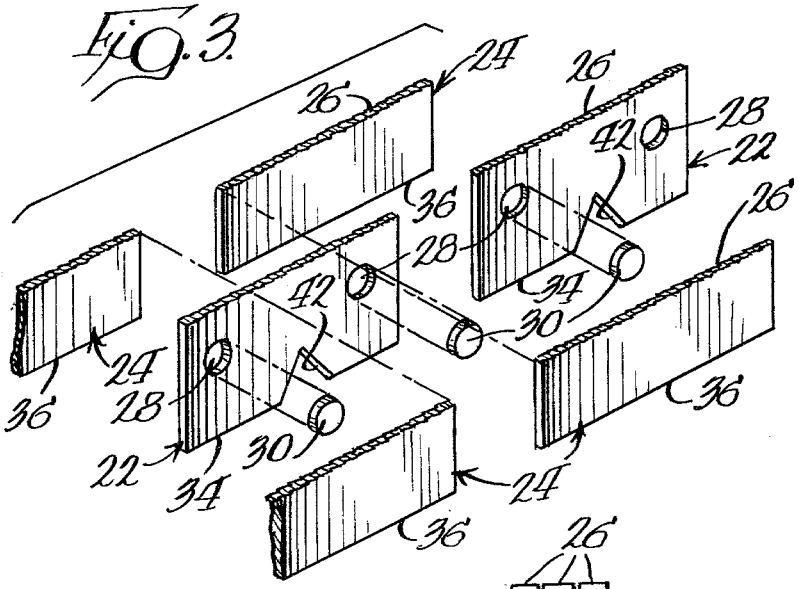
FIG. 3 is an exploded perspective view of the articulated saw blade of FIG. 2 showing individual cutting members.
Figure 6:
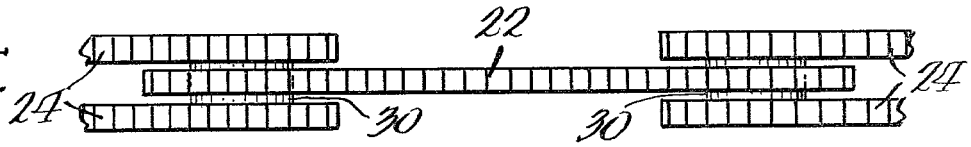
FIG. 6 is a top or plan view of a portion of the first embodiment of the articulated saw blade taken along the plane 6—6 in FIG. 2.

As best seen in the exploded view in FIG. 3, and in the plan view in FIG. 6, middle cutting members 22 are aligned in spaced end-to-end relationship between two opposed exterior rows of exterior cutting members 24. Each middle cutting member 22 is overlapped at each end margin by paired consecutive members, i.e., on either side by one of the exterior cutting members 24 adjacent thereto. Exterior cutting members 24 are aligned in opposed side-by-side relationship to one another.

Figure 5:
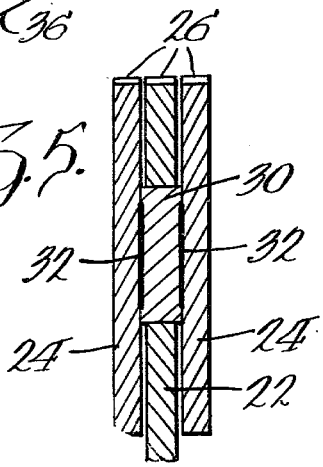
FIG. 5 is a cross-sectional view of the first embodiment of the articulated saw blade taken along the plane 5—5 of FIG. 2.

Formed within each end margin of each middle cutting member 22 is journal bearing 28. Journal bearing 28 presents a substantially right cylindrical bearing surface through each end of each middle cutting member 22. Disposed within the journal bearing is journal 30. Journal 30 is a small disc-shaped shaft and connects two exterior cutting members 24 on either side of each middle cutting member 28. Journal 30 is free to rotate within journal bearing 28, but is secured by appropriate means, such as by electron beam welding or the like, to exterior cutting members 24. FIG. 5 shows a cross section view of journal 30 mounted within one journal bearing 28 of one middle cutting member 22 and secured by electron beam weld 32 on each side thereof adjacent to exterior cutting members 24.

As can be seen in FIG. 2, cutting teeth 26 on exterior cutting members 24 and middle cutting members 22 are in substantially vertical alignment, and the longitudinal margin opposite cutting teeth 26 on each middle cutting member 22 extends beyond exterior cutting members 24. That is, the depth of cutting members 22 is greater than the depth of exterior cutting members 24. The bottom surface of the longitudinal margin of each middle cutting member 22 presents bearing surface 34. Similarly, the bottom surface of the longitudinal margin opposite cutting teeth 26 on exterior cutting members 24 presents bearing surface 36. These bearing surfaces serve to support the cutting members on saw blade support 14.

Figure 4:
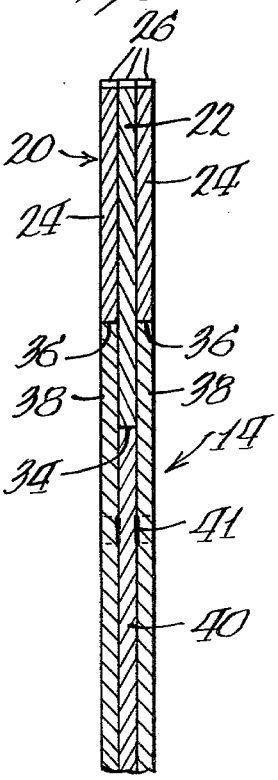
FIG. 4 is a cross section view of the first embodiment of the saw taken along the plane 4—4 in FIG. 1.

A portion of saw blade support 14 is shown in cross section view in FIG. 4 and comprises two elongated blade support side retaining members 38 and one elongated blade support center member 40 disposed between the two side retaining members 38. Side retaining members 38 are joined to center member 40 with spot weld 41. Spot welds 41 can be disposed generally uniformly about the periphery of saw blade support 14 as shown in FIG. 1. Preferably, the longitudinal side edges of blade support 14 are provided with a slight crown. Alternatively, saw blade support 14 can be machined from a single piece, as by diamond wheel milling of a slot in the end face of a suitably shaped plate.

As illustrated in FIG. 4, articulated saw blade 20 is mounted on saw blade support 14 with the lower portion of each of the middle cutting members 22 disposed within the slot formed between the extending peripheral portions of the two side retaining members 38. Bearing surface 34 of each middle cutting member 22 is supported upon the support face provided by the periphery of blade support center member 40. Bearing surfaces 36 of the exterior cutting members 24 are supported on the support faces provided by the periphery of blade support side retaining members 38. This structure retains articulated saw blade 20 within saw blade support 14 and provides continuous support for each exterior and middle cutting member, 22 and 24, as saw blade 20 cuts.

The lower longitudinal margin of middle cutting member 22, opposite cutting teeth 26, is provided with a generally inverted V-shaped notch 42 which acts as a drive engagement means for engaging drive pins 43 of saw blade drive means 16. Notch 42 is shown in FIG. 2 as V-shaped, but other notch shapes may be employed. Saw blade drive means 16 is disposed at one end of saw blade support 14 and comprises a plurality of drive pins means 43 suitable for engaging drive engagement notches 42 in middle cutting members 22. Another suitable structure for this purpose can be a friction drive engaging the lateral side surfaces of the cutting members or a drive sprocket drivably connected to the output shaft of a prime mover (not shown). Drive means 16 comprises a sprocket made up of two substantially parallel discs spaced apart with a plurality of drive pins 43 disposed therebetween near the periphery of the discs, each drive pin 43 being substantially perpendicular to the planes of the discs and being adapted to drivably engage V-shaped notch 42.

The tension of articulated saw blade 20 is determined by the displacement of saw blade drive means 16 relative to saw blade support 14. For adjusting blade tension, adjustment slots 44 are provided in side retaining members 38 and in center member 40 of saw blade support 14 as shown in FIG. 1. Adjustment bolts 45 are threaded into frame 12 and through adjustment slots 44. After saw blade support 14 has been moved relative to saw blade drive means 16 to achieve the desired tension on articulated saw blade 20, bolts 45 are tightened to maintain the tension.

Figure 7:
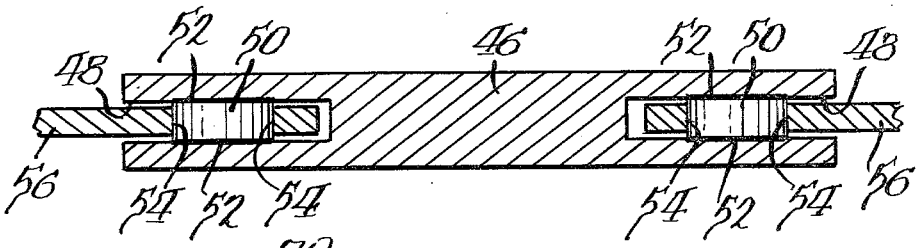
FIG. 7 is a top sectional view of a portion of a second embodiment of an articulated saw blade of this invention.

FIG. 7 illustrates a modification of the preferred embodiment of this invention wherein the articulated band which makes up the saw blade is made of sequentially alternating relatively thick and relatively thin planar cutting members that are pivotably or rotatably connected to one another. A relatively thick planar cutting member 46 has a slot 48 in each end in which a journal 50 is secured by an electron beam weld 52, or other suitable means, to the opposed sidewalls defining the slot. Each journal 50 is received in a journal bearing 54 of thin cutting member 56. The planar cutting members 46 and 56 can be mounted in a saw blade support member having the configuration shown in FIG. 4 for support member 14. The lower portion of relatively thin cutting members 56 and a lower middle (or "keel") portion of relatively thick cutting members 46 is slidably disposed in the central slot of the blade support member 14 while the outer bottom faces of relatively thick cutting members 46 are supported on the periphery of blade support side retaining members 38. Relatively thin cutting members 56 rotate about journals 50 as required to accommodate the curvature of saw blade support member 14.

Figure 8:
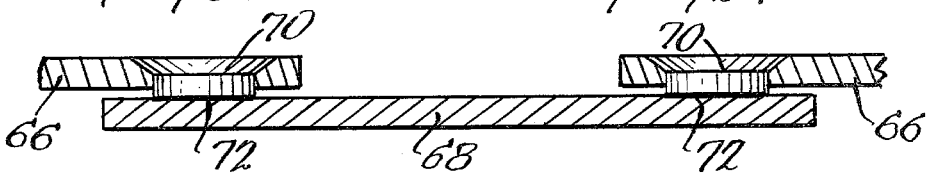
FIG. 8 is a top or plan view of a portion of a third embodiment of an articulated saw blade of this invention.

A third embodiment of the invention is shown in FIG. 8. The cross-section plan view shows two rows of planar cutting members 66 and 68. Each of the cutting members 66 in one row has journal bearing on each end and is connected to overlapping adjacent cutting members 68 with journal 70 disposed in the journal bearing. Journal 70 has an enlarged circular retaining end disposed in a mating countersunk portion of the journal bearing in cutting member 66 and is secured by suitable means, as by a spot weld or electron beam weld 72 to cutting member 68. The band of connected cutting members can be supported in a variety of suitable blade support means having a peripheral slot for receiving the lower portions of the cutting members. The slot could have two bearing surfaces, each at a different depth, for supporting the bottom of the cutting members in the two rows.

Figure 9:
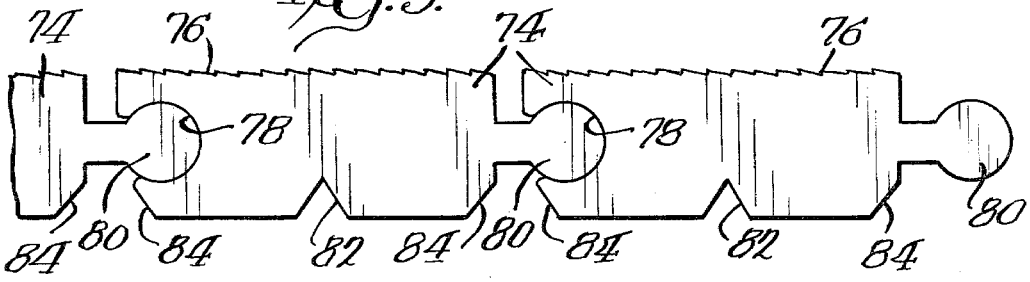
FIG. 9 is a side elevation view of a fourth embodiment of an articulated saw blade of this invention.

A fourth embodiment of this invention is shown in FIG. 9. In this particular case one row of planar cutting members is utilized and consecutive cutting members 74 are disposed in end-to-end alignment. Cutting members 74 are substantially flat and rectangular in shape having opposed longitudinal end margins and opposed end margins. Provided on one of the longitudinal end margins of each cutting member 74 is a plurality of cutting teeth 76 which are generally in the plane of the respective cutting member. Individual cutting members 74 are hingedly joined together by pivotal connection means integral therewith. One end margin of each cutting member 74 is provided with an inwardly extending arcuate notch 78 the major portion of which is defined by a circular arc which receives a complementary, planar extending projection 80 from an adjacent cutting member 74. Extending projection 80 is of a configuration adapted to fit within arcuate notch 78 and thus form a pivotable interconnection therewith. To this end, extending projection 80 is generally circular in shape to substantially match the circular arc of the notch. In order that extending projection 80 not be pulled out of engagement with the circular notch, it is necessary that the circular arc of material forming the circular notch extends greater than $\pi$ radians or 180°. To allow for the pivotal movement of cutting members 74 as they ride around the curved end portions of an elongated saw blade support driven by pins or the like engaging drive notches 82, bevels 84 are provided on each end of cutting members 74 and the extent of the circular notch is preferably less than about $3/2\pi$ radians or about 270°. With the type of single-row, connected, cutting member articulated saw blade shown in FIG. 9, a cut having a very narrow kerf can be achieved.

Figure 10:
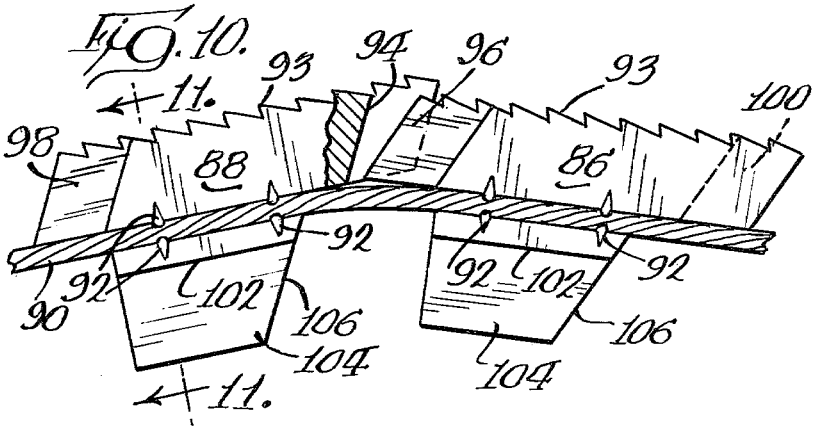
FIG. 10 is a side elevation view of a fifth embodiment of an articulated saw blade of this invention.
Figure 11:
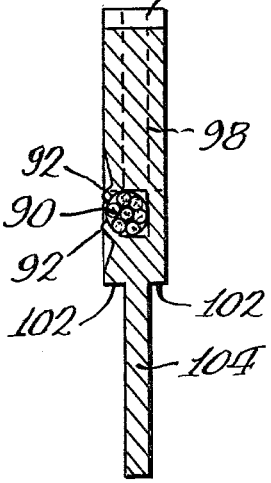
FIG. 11 is a cross section view of the fifth embodiment of the articulated saw blade taken along plane 11—11 in FIG. 10.

FIG. 10 shows a fifth embodiment of the present invention. Individual planar cutting members 86 and 88, with teeth 93, are spaced in end-to-end relation and hingedly connected to one another by steel cable 90 or the like which is disposed within a channel in each cutting member and crimped to each cutting member with a plurality of crimps 92 so as to form an array of consecutive cutting members. The cable 90 and crimp connection 92 is shown in cross section in FIG. 11. Cutting members 88 and 86 are identical in shape. Each member has an end slot and an end projection which receive and engage, respectively, the end projection and end slot of adjacent members, whereby the articulated band of connected cutting members is interlocked to resist lateral forces. Cutting member 88 is illustrated as having an end slot 94 receiving end projection 96 of cutting member 86. On the opposite end of member 88 is end projection 98 and on the opposite end of member 86 is end slot 100. Shoulder 102 on each side of central keel portion 104 is provided to be supported on the periphery of a blade support member, such as blade support member 14 illustrated in FIG. 4, and keel portion 104 is provided to be slidably disposed within the central slot of such a blade support member. Again, to allow cutting members 86 and 88 to follow the curved ends of a saw blade support, bevels 106 can be provided at the ends of cutting members below the fulcrum point on the cable 90 and/or sufficient space can be maintained between central keel portions 104.

Figure 12:
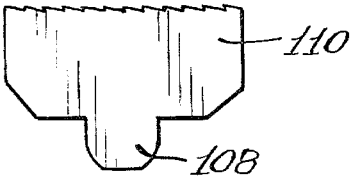
FIG. 12 is a side elevation view of a sixth embodiment of an articulated saw blade cutting member of this invention.

In the modifications shown in FIGS. 7, 8, and 9, the cutting members are driven by drive pins in a saw blade drive means which engage in V-shaped drive notches, such as notches 82 (FIG. 9) disposed in one of the longitudinal margins of each of the respective cutting members. For the embodiment illustrated in FIG. 10, drive pins engage bevel 106 on keel portion 104. Alternatively, drive notches could be provided in keel portion 104. However, other suitable drive engagement means may be employed. For example, in FIG. 12 there is shown a modification wherein a drive tooth 108 having a gear tooth-like profile projects from a longitudinal margin of cutting member 110. Such a drive tooth 108 can be received and driven by a gear or a pocket provided in a sprocket-type saw blade drive means.

Figures 13, 14, 15:
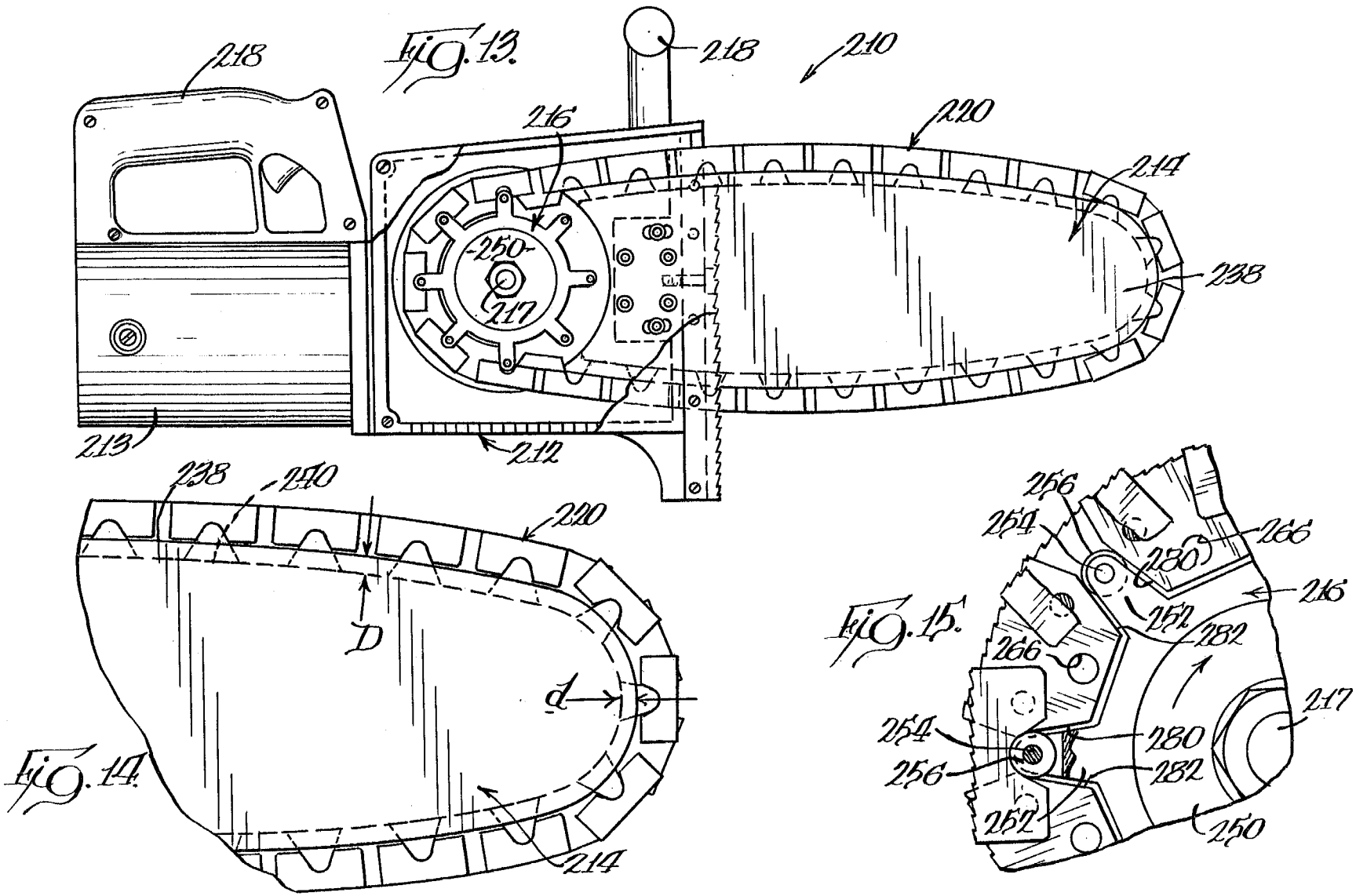
FIG. 13 is a side elevation view of a second embodiment of the saw of this invention, partially broken away to show interior detail.
FIG. 14 is a side elevation of the distal end portion of a seventh embodiment of an articulated saw blade of this invention.
FIG. 15 is a fragmentary view of a portion of the saw illustrated in FIG. 13.

A second embodiment of the saw of the present invention is generally designated by reference numeral 210 in FIG. 13. The saw 210 includes saw frame 212 on which is mounted saw blade support 214, saw blade drive means 216, and motor 213. The saw 210 is portable and can be held by handles 218 for cutting at any angle.

An articulated saw blade 220 is disposed about the periphery of the saw blade support 214 and engaged at one end of the saw 210 by saw blade drive means 216 which, in turn, is driven via shaft 217 by motor 213 operating through a suitable gear drive system to be explained in more detail hereinafter. Of course, the motor 213 may be an electric motor, an internal combustion engine, or other suitable prime mover.

Figure 19:
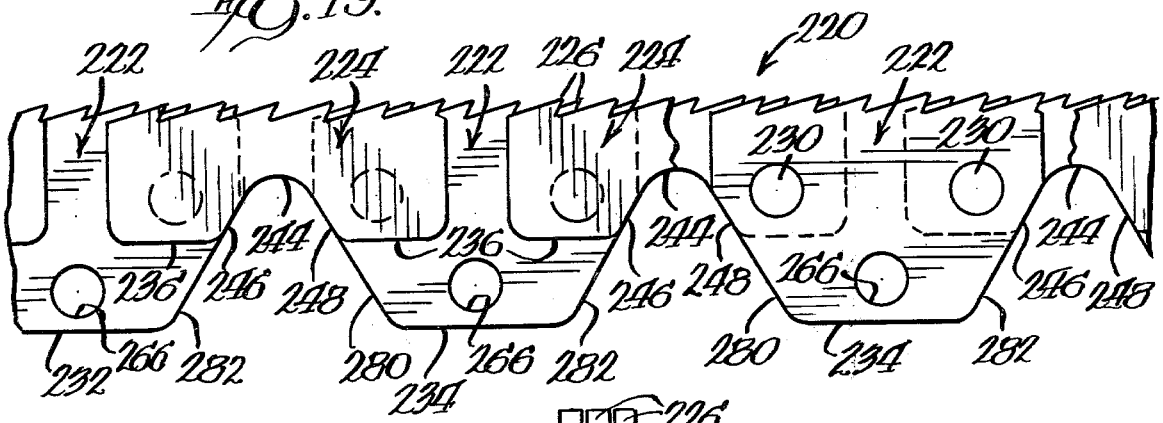
FIG. 19 is a side elevation view of the seventh embodiment of the saw blade illustrated in FIG. 18.

The side profile shape of the articulated saw blade 220 is more clearly shown in FIG. 19. Planar middle cutting members 222 are disposed between exterior or outer rows of planar exterior cutting members 224. Both the middle cutting members 222 and the exterior cutting members 224 have a generally elongate planar shape. Each planar cutting member has two opposed longitudinal margins and two opposed end margins. A plurality of cutting teeth 226 are disposed along one longitudinal margin of each of the cutting members and are generally in the plane of the respective cutting member. The cutting teeth 226 of each cutting member form a substantially continuous circumferential row of cutting teeth about the outer periphery of the articulated saw blade 220 having a positive rake.

Figure 18:
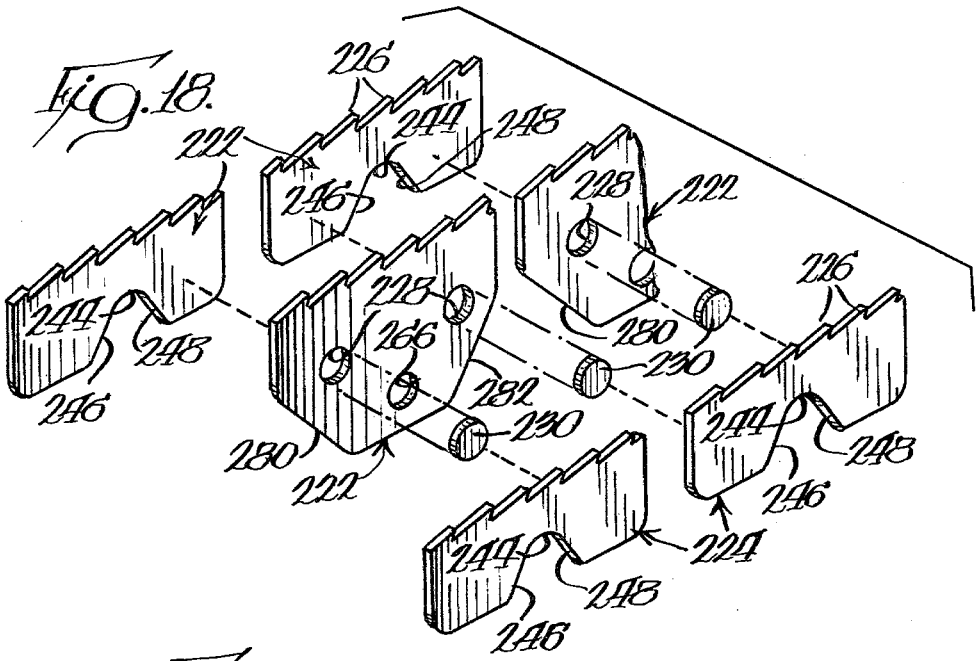
FIG. 18 is an exploded perspective view of the seventh embodiment of the articulated saw blade of this invention and showing individual cutting members.
Figure 20:
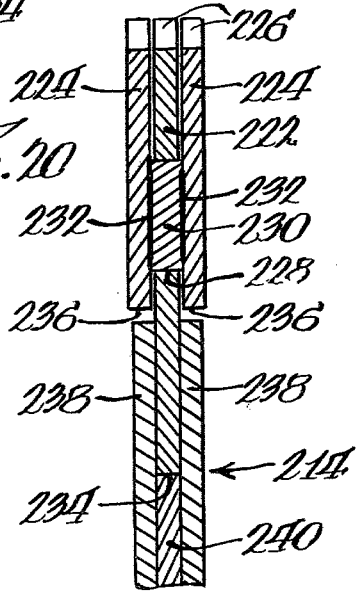
FIG. 20 is a fragmentary cross-sectional view of the second embodiment of the saw taken along the plane 20—20 in FIG. 16.

As best seen in the exploded perspective view in FIG. 18 and in the cross-sectional elevation view of FIG. 20, middle cutting members 222 are aligned in spaced end-to-end relationship between two opposed exterior rows of cutting members 224. Each middle cutting member 222 is overlapped at each end margin by paired consecutive members, i.e., on either side by one of the exterior cutting members 224 adjacent thereto. Exterior cutting members 224 are aligned in opposed side-by-side relationship to one another.

Formed within each end margin of each middle cutting member 222 is a journal bearing 228. Journal bearing 228 presents a substantially right cylindrical bearing surface through each end of each middle cutting member 222. A journal 230 is disposed within the journal bearing 228. Journal 230 is a small disc-shaped shaft and connects two exterior cutting members 224 on either side of each middle cutting member 222. Journal 230 is free to rotate within journal bearing 228, but is secured by appropriate means, such as by electron beam welding or the like, to exterior cutting members 224. FIG. 20 shows a cross section view of journal 230 mounted within a journal bearing 228 of one middle cutting member 222 and secured by electron beam weld 232 on each side thereof to adjacent exterior cutting members 224.

As can be seen in FIG. 19, cutting teeth 226 on exterior cutting members 224 and middle cutting members 222 are in substantially vertical alignment, but the longitudinal margin opposite cutting teeth 226 on each middle cutting member 222 extends beyond exterior cutting members 224. That is, the depth of each middle cutting member 222 is greater than the depth of each exterior cutting member 224.

The bottom surface of the longitudinal margin of each middle cutting member 222 presents bearing surface 234. As illustrated in FIG. 20, bearing surface 234 serves to support each cutting member 222 on saw blade support 214.

The saw blade 214 comprises two elongated blade side retaining members 238 and one elongated blade support center member 240 disposed between the two side retaining members 238. Side retaining members 238 are joined to center member 240 by suitable means such as welding or the like. Alternatively, saw blade support 214 can be machined from a single piece, as by diamond wheel milling of a slot in the peripheral face of a suitably shaped plate. Preferably, as illustrated in FIG. 13, the side edges of the members 238 and 240 (i.e., the peripheral edges of the saw blade support 214) are provided with a slight crown.

As illustrated in FIG. 20, the articulated saw blade 220 is mounted on the saw blade support 214 with the lower portion of each of the middle cutting members 222 disposed within the slot formed between the extending peripheral portions of the two side retaining members 238. Bearing surface 234 of each middle cutting member 222 is supported upon the support face provided by the peripheral surface of the blade support center member 240.

The bottom surfaces 236 of the exterior cutting members 224 are preferably spaced above the side retaining members 238 as illustrated in FIG. 20. However, if desired, the exterior cutting members 224 may be actually in contact with and supported by the side retaining members 238 on the bottom surfaces 236.

Preferably, as best illustrated in FIG. 14, the side retaining members 238 extend outwardly from the center member 240 a distance D in the region between the saw blade drive means and the arcuate distal end of the saw which is greater than the outward extension distance d at the arcuate distal end of the saw. In any case, the novel articulated saw blade 220 of the present invention is retained within the saw blade support 214 and the saw blade support 214 provides a continuous support for at least the middle cutting members 222 as the saw blade 220 cuts.

As best illustrated in FIGS. 18 and 19, the lower longitudinal margin of each exterior cutting member 224, opposite cutting teeth 226, is provided with a notch means or notch defined by an arcuate wall 244 and by two generally converging walls 246 and 248 that merge with the arcuate wall 244. This notch acts as a drive engagement means for engaging the saw blade drive means 216 as will next be described.

Figure 16:
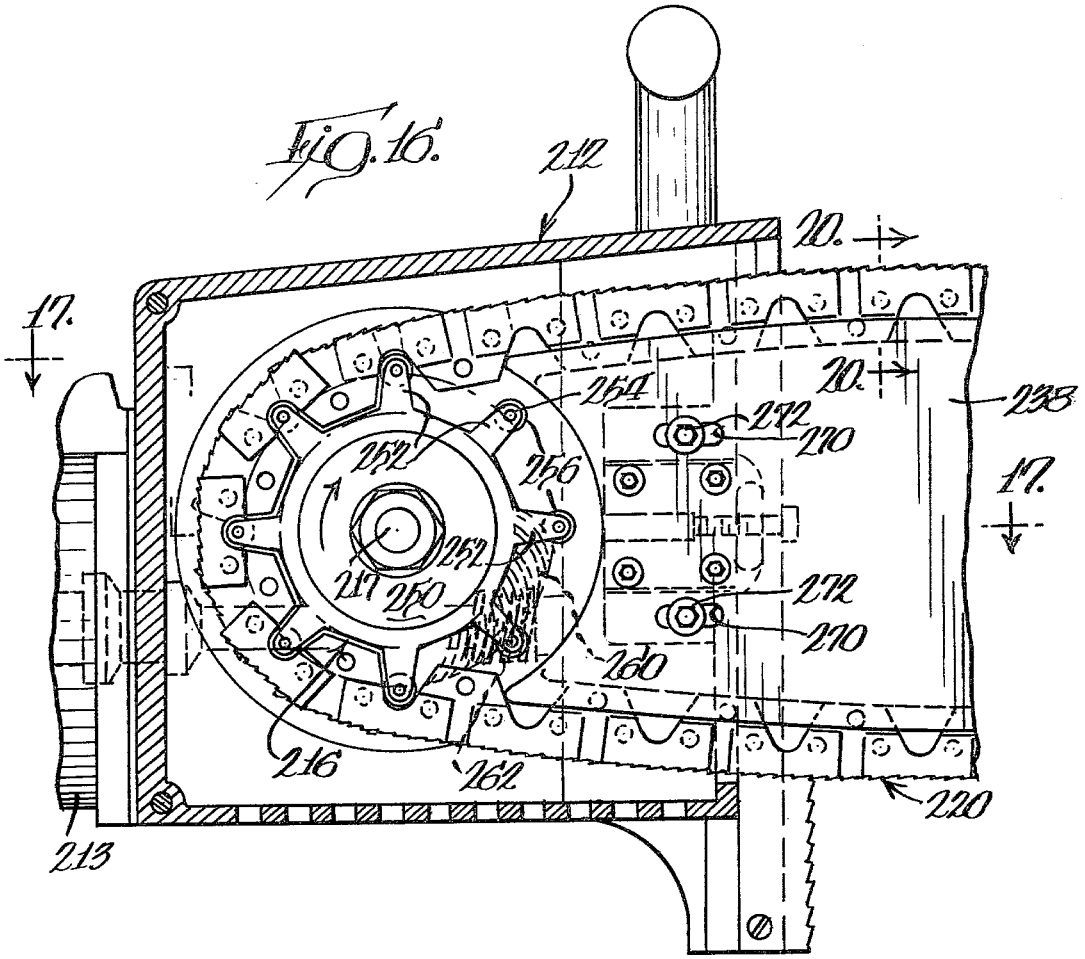
FIG. 16 is a side elevation view of the left-hand end of the second embodiment of the saw illustrated in FIG. 13, partially broken away to show interior detail.
Figure 17:
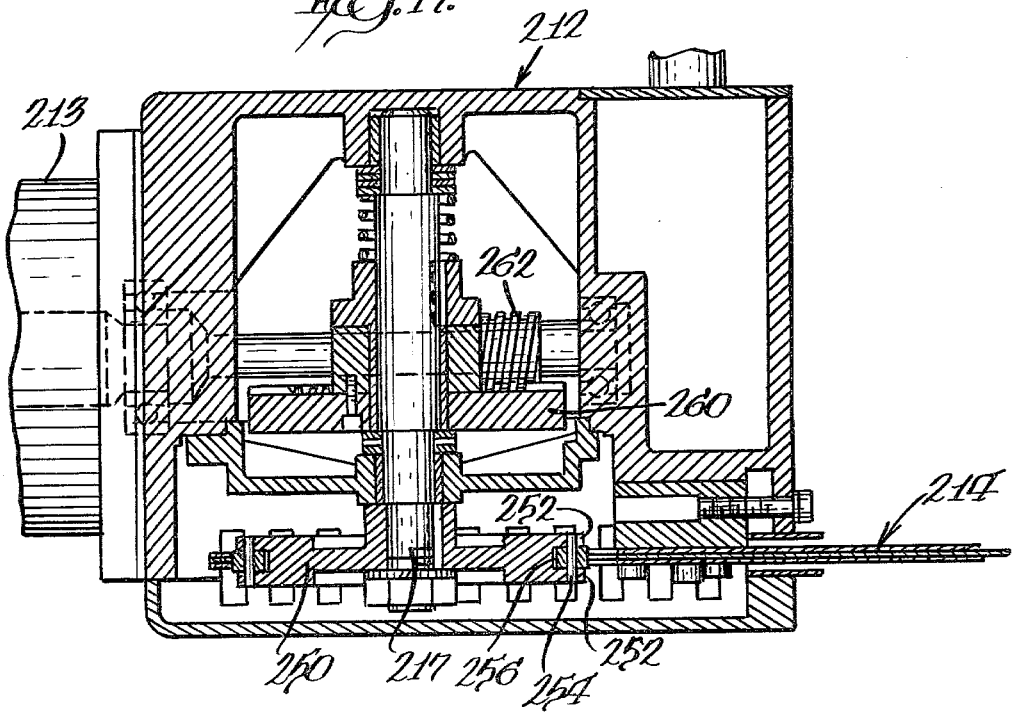
FIG. 17 is a cross-sectional view of the second embodiment of the saw taken along the plane 17—17 in FIG. 16.

With reference now to FIGS. 15, 16, and 17, the saw blade drive means 216, disposed at one end of saw blade support 214, comprises a sprocket or drive wheel 250 mounted on shaft 217. The sprocket 250 has a plurality of circumferentially spaced pairs of spaced-apart parallel spokes 252 which project radially outwardly in relation to shaft 217. A shaft 254 is mounted between each pair of spaced-apart parallel spokes 252 and a roller 256 is mounted on each shaft 254 for intermittently entering the notches of the exterior cutting members 224 and for engaging the exterior cutting members 224 to move the articulated saw blade 220 around the periphery of the saw blade support means 214.

The sprocket 250 may be driven by a suitable gear system, such as a skew-axis gear system of conventional design well known to those skilled in the art of drive gear system design. Briefly, as illustrated in FIG. 17, the system may include a right angle drive gear 260 such as a spiral bevel or hypoid gear and an engaging pinion gear 262 which may be tapered or untapered. The pinion gear 262 is connected by suitable conventional shaft and coupling means through frame 212 to motor 213.

Since the exterior planar cutting members 224 are aligned in parallel pairs, each roller 256 necessarily engages two exterior cutting members 224 simultaneously. This is advantageous when the cutting members are formed from very thin sheet material since the total bearing surface against which the roller 256 impinges is then necessarily twice as great than if only one planar cutting member were engaged by the roller.

With the novel articulated saw blade 220 of the present invention, it is preferable that the relative positions of the drive notches of the exterior cutting members 224 and the ends of each middle cutting member 222 be oriented so that all of the journals 228 are properly aligned and so that the drive notches are uniformly spaced along the saw blade 220.

The notches of the exterior cutting members 224 function as chambers to carry saw dust out of the kerf. Additionally, the middle planar cutting members 222 can be provided with one or more holes or apertures 266 adjacent the bottom margin to function as a trap for lubricant so that lubricant can be carried along the saw blade support 214.

With reference to FIGS. 15 and 18, it is seen that the middle planar cutting members 222 can be provided with slanted wall portions 280 and 282 which, by appropriate design, may, if desired, be configured to also contact the drive rollers 256 on sprocket 250. Thus, with such a design the articulated saw blade 220 is driven at each roller 256 in such a manner that the roller 256 simultaneously engages three cutting members in the driving direction. This arrangement further distributes the driving force over a larger bearing area.

This slight curvature or crown of the blade support member 214 facilitates tensioning of the articulated saw blade 220. To effect such tensioning, adjustment slots 270 are provided in the side retaining members 238 and blade support center member 240 at one end of the saw blade support 214 as illustrated in FIG. 16. Adjustment bolts 272 are threaded into a portion of frame 212 and project through the adjustment slots 270. The saw blade support 214 is then moved relative to the frame 212, and hence relative to the saw blade drive means 216 mounted on the frame 212, to achieve the desired tension on the articulated saw blade 220. The bolts 272 are tightened to maintain the desired tension.

Figure 21:
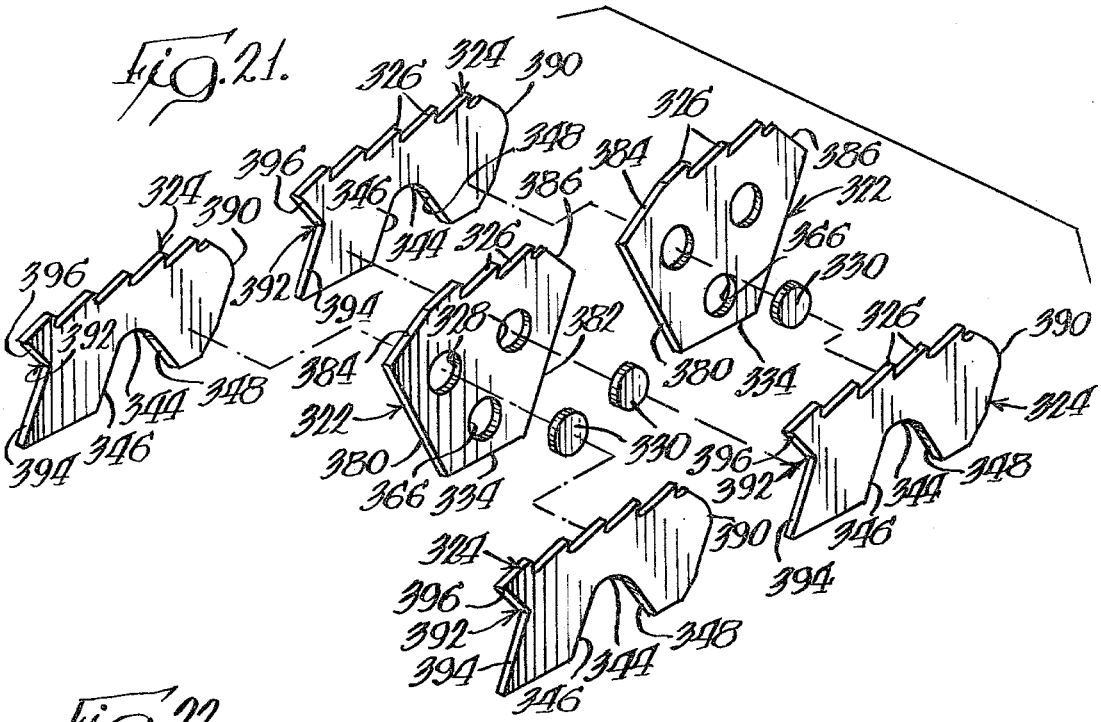
FIG. 21 is an exploded perspective view of the eighth embodiment of the articulated saw blade of this invention.
Figure 22:
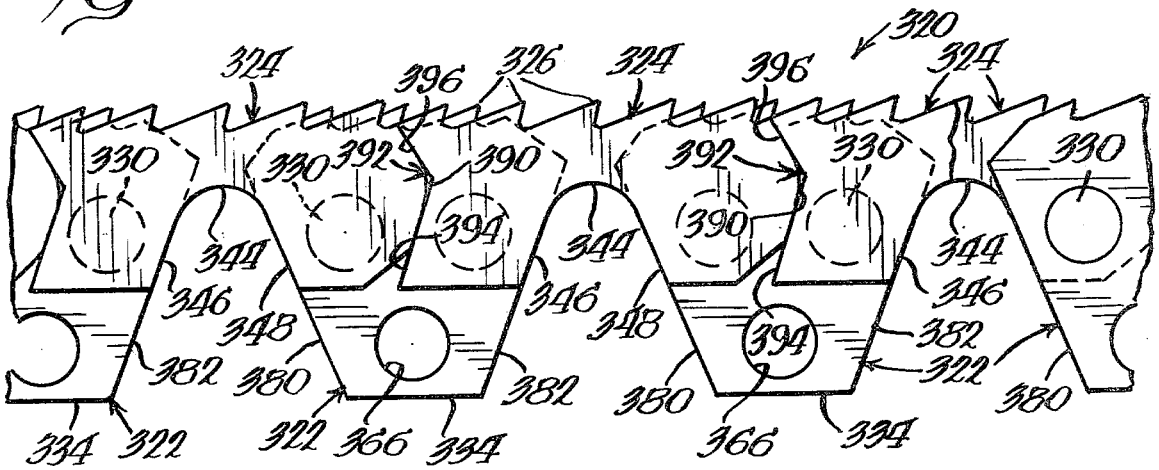
FIG. 22 is a side elevation view of the saw blade illustrated in FIG. 20.

An eighth embodiment of the articulated saw blade, as illustrated in FIGS. 21 and 22, may be used in place of the seventh embodiment of the saw blade 220 and is particularly well suited for the saw 210 illustrated in FIG. 13. Planar middle cutting members 322 are disposed between two middle rows of planar exterior cutting members 324. The exterior cutting members 324 have a generally elongate planar shape while the middle cutting members 322 have an irregular, six-sided planar shape with the overall length about equal to the overall width thereof.

Each planar cutting member 322 and 324 has two opposed longitudinal margins and two opposed end margins. A plurality of cutting teeth 326 are disposed along one longitudinal margin of each of the cutting members and are generally in the plane of the respective cutting member, though the teeth on the exterior cutting members 324 preferably have a predetermined degree of set to either side in accordance with conventional saw blade tooth design. Preferably the teeth of middle cutting members 322 have minimal or no set. The cutting teeth 326 of individual cutting member collectively forming an articulated saw blade together provides a substantially continuous circumferential array of cutting teeth about the outer periphery of the articulated saw blade having a positive rake.

As best seen in the exploded perspective view in FIG. 21, the middle cutting members 322 are aligned in spaced end-to-end relationship between the two opposed outer rows of cutting members 324. Each middle cutting member 322 is overlapped at each end margin by paired consecutive members, i.e., on either side by one of the exterior cutting members 324 adjacent thereto. The exterior cutting members 324 in one row are aligned in opposed side-by-side relationship with the exterior cutting members 324 in the other row.

Formed within each end margin of each middle cutting member 322 is a journal bearing 328. Each journal bearing 328 presents a substantially right cylindrical bearing surface and defines an aperture through each end of each middle cutting member 322. A journal 330 is disposed within each journal bearing 328. Journal 330 is a small, disc-shaped shaft and connects two exterior cutting members 324 on either side of each middle cutting member 322. Journal 330 is free to rotate within journal bearing 328, but is secured by appropriate means, such as by electron beam welding or the like, to exterior cutting members 324.

As can be seen in FIG. 22, the cutting teeth 326 on exterior cutting members 324 and middle cutting members 322 are in substantially horizontal, overlapping alignment. However, the longitudinal margin opposite the cutting teeth 326 on each middle cutting member 322 extends beyond the corresponding longitudinal margin of exterior cutting members 324. That is, the depth of each middle cutting member 322 is greater than the depth of each exterior cutting member 324. The bottom surface of the longitudinal margin of each middle cutting member 322 presents a bearing surface 334. This bearing surface 334 serves to support each cutting member 322 on the saw blade support 214 of the saw 210 illustrated in FIG. 13 in a manner analogous to the support of the seventh embodiment of the saw blade 220 illustrated in FIGS. 13–20 and previously described with reference to those figures.

Similarly, as with the seventh embodiment of the saw blade 210 illustrated in FIGS. 13–20 and previously described, the lower longitudinal margin of each exterior cutting member 324, opposite the cutting teeth 326, is provided with a notch or cut-out defined by an arcuate wall 344 and by two generally converging walls 346 and 348 that merge with the arcuate wall 344. This notch acts as a drive engagement means for engaging the saw blade drive means 216 of saw 210 illustrated in FIG. 13 in the manner previously described with respect to the seventh embodiment of the saw blade 220. The notches of the exterior cutting members 324 also may function as chambers to receive and carry sawdust out of the kerf. Additionally, the middle cutting members 322 can be provided with one or more holes or apertures 366 adjacent the bottom margin to function as a trap for lubricant so that the lubricant can be carried along the saw blade support.

As illustrated in FIG. 21, the middle cutting members 322 can be provided with lower slanted wall portions 380 and 382 which, by appropriate design, may be shaped also to contact the drive mechanisms of the saw 210 illustrated in FIG. 13 in a manner previously described with respect to the seventh embodiment of the saw blade 220. Each middle planar cutting member 322 can be provided with upper slanted wall portions 384 and 386. The end margins of each middle cutting member 322 are thus seen to have an outwardly extending portion free of cutting teeth and merging with the cutting face on the top of the member. This configuration effectively provides a clearance area for permitting rotation of the adjacent exterior cutting members to swing their respective cutting faces freely into and out of a plane defined by the cutting faces of the middle cutting members 322. This configuration thus accommodates the articulation of the saw blade about the circular sprockets at each end of the saw and is most useful with saw blades having a relatively large set to the cutting teeth 326.

The eighth embodiment of the saw blade of the present invention illustrated in FIGS. 21 and 22 includes yet another very important feature—that of cutting teeth alignment. One of the two end margins of each exterior cutting member 324 extends outwardly to define a convex abutment portion or surface 390 and the other of the two end margins defines an engaging means extending inwardly to define a notch or concave receiving portion 392. The convex portion 390 of one exterior cutting member extends into and is received in the notch 392 of an adjacent exterior cutting member. As illustrated in FIG. 22, the cutting members are adapted to be aligned with their cutting faces in a substantially common plane, at least during the portion of their travel around the saw blade support where the cutting teeth are in contact with the workpiece to be cut. Further, owing to the journalled construction, the end-to-end aligned exterior cutting members are rotatable about their respective journals to orient their respective cutting faces into and out of the substantially common cutting plane. The direction of the rotation of the exterior cutting members about their respective journals is towards the bottom bearing surface 334 of the particular middle cutting member to which they are mounted. The convex abutment portion 390 and the concave receiving portion 392 are engaged when the two exterior cutting members are oriented as illustrated in FIG. 22 with their respective cutting faces lying in the common plane so as to prevent rotation of those cutting members about their respective journals beyond that common plane, i.e., in a direction away from the middle cutting member bottom bearing surface 334. However, owing to the configuration of the convex portion 390 and concave portion 392, rotation of the two exterior cutting members relative to the middle cutting member to which they are mounted is accommodated in a direction toward the middle cutting member bearing surface 334.

Although the exterior cutting members 324 are illustrated as having a convex abutment portion 390 and a concave receiving portion 392, it is to be realized that it is sufficient that one of the end margins of an exterior cutting member defines a single abutment surface for restricting the rotational movement of the next consecutive cutting member in the array beyond the common plane and that the other of the two end margins defines a single protuberance providing a surface for engaging the abutment surface of the next consecutive exterior cutting member in the array beyond the common plane, thus restricting the rotational movement of the cutting members.

In the embodiment illustrated in FIG. 21, the concave receiving portion 392 is defined by a pair of abutment surfaces, lower abutment surface 394 and upper abutment surface 396. The convex portion 390 can be regarded as the protuberance providing a surface for engaging one or both of the abutment surfaces 394 and 396. Depending upon the precise configuration of the end margins of the exterior cutting members, one abutment surface, 394 or 396, may be sufficient, when engaged with a suitably designed protuberance or convex portion 390, for preventing the rotation of the exterior cutting members beyond the plane of the aligned cutting faces.

With the novel end margin design of the exterior cutting members described above, the articulated saw blade has enhanced rigidity when the cutting faces are aligned in the substantially common cutting plane during the sawing process. This is particularly important for articulated saw blades comprising individual cutting members made of relatively thin sections.

Compared to the seventh embodiment of the saw blade illustrated in FIGS. 18 and 19, it is seen that the eighth embodiment of the saw blade illustrated in FIGS. 21 and 22 provides a continuous array of cutting teeth along the end-to-end aligned exterior cutting members. That is, there is substantially no space between the ends of adjacent exterior cutting members as there are with the exterior cutting members 224 of the seventh embodiment of the saw blade illustrated in FIGS. 18 and 19. As can be seen in FIG. 19, in the space between the two ends of end-to-end aligned, adjacent exterior cutting members, the continuation of the array of cutting teeth is provided by the single middle cutting member 222. Hence, in this region, there is only one row of cutting teeth. On either end of this region, three thicknesses of cutting teeth are provided (one middle cutting member and two exterior cutting members). Also, in the space between two middle cutting members, two sets of cutting teeth are provided by the two exterior cutting members which join the two middle cutting members.

In contrast, the eighth embodiment of the saw blade illustrated in FIGS. 21 and 22 provides for a continuous array of cutting teeth wherein the array includes at least two parallel sets of cutting teeth at any location along the saw blade. Because the exterior cutting members are in end-to-end abutment on the middle cutting members, there is no region of the saw blade where the cutting teeth are provided solely by the middle cutting members. Therefore, this embodiment of the saw blade will be preferred in those instances where it is desired to provide at least two parallel rows of cutting teeth continuously along the saw blade.

The cutting teeth of the embodiment described herein can be of any hardness and shape desired. The cutting teeth can be carbide-clad or can be carbide or diamond particles for cutting stone, cement, or other hard material, if desired.

The saw may be powered by any suitable means such as an air motor, an internal combustion engine, an electric motor, a hydraulic motor, and the like.

The novel use of thin planar cutting members disclosed herein offers great advantages in ease and economy of manufacture. Relatively inexpensive stamping, fixturing, and spot welding or electron beam welding techniques are all that is required to fabricate the saw blade of this invention. A great variety of sprocket type engagements with each blade cutting member, or with only some of the blade cutting members, can be used. The blade drive rate can also be varied by well-known means such as a simple gear, chain, or belt reduction, if desired.

The saw disclosed herein is thus seen to have many advantages over existing power-driven saws. The present articulated saw blade can be made from relatively thin planar individual cutting members. The cutting members, being joined by novel means, add little or no extra lateral thickness to the saw blade. Thus, the cutting teeth do not have to be unnecessarily raked outwardly so as to make an enlarged kerf in order to accommodate lateral protuberances on the sides of the cutting blades. The side surfaces of the cutting members do not have laterally extending projections or protuberances and can be made very smooth. This also contributes to a smooth cut. The narrower kerf provided by this invention produces less cutting waste and, therefore, conserves material. Further, the narrower kerf requires less power and, therefore, requires less energy input to drive the saw.

The saw blade of this invention is more efficient, per unit length of blade, than a conventional chain saw because each member of the articulated cutting band has a plurality of cutting teeth. There are no bare linking members without teeth as in a chain saw.

The saw blade of this invention is seen to be lighter than the typical chain saw blade and thus has less momentum during operation at a given speed. Thus, with the novel saw blade of this invention, less torque is required to accelerate the articulated saw blade to the design speed in a given time interval. Further, if the articulated saw blade should break, the destructive effects of such a break would be less severe than with the heavier chain saw type blade.

Compared to reciprocating saws or hand saws, the saw of this invention is more efficient in that it continuously cuts and does not have a wasted return motion.

The saw of this invention is portable and does not have a throat limitation such as found in a conventional band saw. Thus, the saw has the advantage of unlimited vertical capacity.

Since the individual cutting members of the saw blade of this invention do not have to be made to bend or flex as does a band saw blade, the cutting members of this invention are not limited to only those materials that can withstand flexing and bending. This permits the use of many different types of materials, including those of any hardness or temper desired.

From the foregoing, it will be observed that numerous other variations, modifications and rearrangements of parts may be effected without departing from the true spirit and scope of this invention.

I claim:

1. A saw blade comprising;

an endless array of substantially planar cutting members which are hingedly interconnected and together form a substantially planar, articulated band; each substantially planar cutting member in said endless array having a pair of opposed longitudinal margins, a pair of end margins, a plurality of cutting teeth disposed along one longitudinal margin thereof to define a cutting face thereon, and a bearing face disposed along the other of said longitudinal margins; said planar cutting members being situated in said array so as to present a circumferential row of cutting teeth about the periphery of said articulated band, said array having a plurality of exterior cutting members and a plurality of middle cutting members; said array further having journalled connector means comprising a journal and a journal bearing associated therewith for rotatably connecting adjacent cutting members; said exterior cutting members being aligned in end-to-end relationship in two substantially parallel exterior rows; said middle cutting members being disposed therebetween and aligned in a middle row in spaced end-to-end relationship; said cutting faces of said exterior cutting members being substantially aligned with said cutting faces of said middle cutting members; each said exterior cutting member overlapping two adjacent end margins of said middle cutting members and being mounted on consecutive journals extending from either side of the adjacent end margins of said middle cutting members; said middle cutting members being deeper than said exterior cutting members to provide middle cutting member bearing faces which project beyond the depth of said exterior cutting members; each said deeper middle cutting member adapted for being disposed in a peripheral slot of a saw blade support with said middle cutting member bearing face slidably abutting the bottom of the slot; and said exterior cutting members being disposed alongside said middle cutting members with said exterior cutting member bearing faces adapted for slidably abutting peripheral portions of the blade support on each side of said slot; each pair of adjacent exterior cutting members adapted to be rotated about their respective journals to orient their respective cutting faces into and out of a substantially common plane; one of the two end margins of each exterior cutting member extending outwardly to define a convex abutment portion and the other of said two end margins of each said exterior cutting member defining an engaging means extending inwardly to define a concave receiving portion, the convex portion of one exterior cutting member extending into and being received in the concave receiving portion of an adjacent exterior cutting member for accommodating the rotation of two adjacent, end-to-end aligned exterior cutting members on their respective journals on one of said middle cutting members in a direction toward said bearing face of said middle cutting member and for preventing rotation of the two exterior cutting members about their respective journals on the middle cutting member in a direction away from said middle cutting member bearing surface beyond the orientation where the cutting faces of said exterior cutting members lie in the substantially common plane.

2. The saw blade in accordance with claim 1 in which each of said middle cutting members in said array overlaps four exterior cutting members and wherein the cutting members are rotatably connected by journalled connector means comprising a journal and a journal bearing associated therewith.

3. The saw blade in accordance with claim 2 wherein each said middle cutting member is provided with at least one circular aperture defining the journal bearing, wherein said journal has a disc configuration and is received within said aperture, and wherein one of said exterior cutting members is rigidly joined to said journal.

4. The saw blade in accordance with claim 1 including a drive engagement means associated with at least one row of said cutting members.

5. A saw blade comprising:

an endless array of substantially planar cutting members which are hingedly interconnected and together form a substantially planar, articulated band; each substantially planar cutting member in said endless array having a pair of opposed longitudinal margins, a pair of end margins, a plurality of cutting teeth disposed along one longitudinal margin thereof to define a cutting face thereon, and a bearing face disposed along the other of said longitudinal margins; said planar cutting members being situated in said array so as to present a circumferential row of cutting teeth about the periphery of said articulated band, said array having a plurality of exterior cutting members and a plurality of middle cutting members; said array further having journalled connector means comprising a journal and a journal bearing associated therewith for rotatably connecting adjacent cutting members; said exterior cutting members being aligned in end-to-end relationship in two substantially parallel exterior rows; said middle cutting members being disposed therebetween and aligned in a middle row in spaced end-to-end relationship; said cutting faces of said exterior cutting members being substantially aligned with said cutting faces of said middle cutting members; each said exterior cutting member overlapping two adjacent end margins of said middle cutting members and being mounted on consecutive journals extending from either side of the adjacent end margins of said middle cutting members; said middle cutting members being deeper than said exterior cutting members to provide middle cutting member bearing faces which project beyond the depth of said exterior cutting members; each said deeper middle cutting member adapted for being disposed in a peripheral slot of a saw blade support with said middle cutting member bearing face slidably abutting the bottom of the slot; and said exterior cutting members being disposed alongside said middle cutting members, each pair of adjacent, end-to-end aligned exterior cutting members adapted to be rotated about their respective journals to orient their respective cutting faces into and out of a substantially common plane; one of the two end margins of each exterior cutting member defining a notch having an abutment surface for restricting rotational movement of the next consecutive exterior cutting member in said array beyond said common plane and the other of the two end margins defining a protuberance for engaging said abutment surface on the next preceding exterior cutting member for restricting rotational movement of the next preceding exterior cutting member in said array beyond said common plane when at least two adjacent exterior cutting members on the same side of the middle cutting members of the saw blade have the respective cutting faces thereof oriented in a common plane.

6. The saw blade in accordance with claim 5 in which each said exterior cutting member is provided with a notch means in said longitudinal margin opposite said cutting face for engaging a drive means for said saw blade.

7. The saw blade in accordance with claim 6 in which said notch means is defined by an arcuate wall of said cutting member and by two generally converging walls of said cutting member that merge with said arcuate wall.

8. The saw blade in accordance with claim 5 in which each said planar member has between four and ten teeth per inch along one longitudinal margin thereof.

9. The saw blade in accordance with claim 5 in which said notch and said protuberance are shaped to cooperate to permit the rotation of the two adjacent exterior cutting members relative to a middle cutting member on which they are mounted in a direction to move said exterior cutting member teeth away from said common plane and toward said middle cutting member bearing face so as to permit said saw blade band to be articulated about the curvature of a curved saw blade support.

10. The saw blade in accordance with claim 9 in which said notch has a pair of spaced apart abutment surfaces for restricting rotational movement of the next consecutive exterior cutting member in said array beyond said common plane and in which said other of two end margins defines a pair of spaced apart protuberances for engaging said abutment surfaces on the next preceding exterior cutting member for restricting rotational movement of the next preceding exterior cutting member in said array beyond said common plane when at least two adjacent exterior cutting members on the same side of the middle cutting members of the saw blade have the respective cutting faces thereof oriented in the common plane.

11. A saw blade comprising:

an endless array of substantially planar cutting members which are hingedly interconnected and together form a substantially planar, articulated band; each substantially planar cutting member in said endless array having a substantially identical and uniform thickness and having a pair of opposed longitudinal margins, a pair of end margins, a plurality of cutting teeth disposed along one longitudinal margin thereof to define a cutting face thereon, and a bearing face disposed along the other of said longitudinal margins; said planar cutting members being situated in said array so as to present a circumferential row of cutting teeth about the periphery of said articulated band, said array having a plurality of exterior cutting members and a plurality of middle cutting members; said array further having journalled connector means comprising a journal and a journal bearing associated therewith for rotatably connecting adjacent cutting members; said exterior cutting members being aligned in contiguous end-to-end relationship in two substantially parallel exterior rows; said middle cutting members being disposed therebetween and aligned in a middle row in spaced end-to-end relationship; said cutting faces of said exterior cutting members being substantially aligned with said cutting faces of said middle cutting members; each said exterior cutting member overlapping two adjacent end margins of said middle cutting members and being mounted on consecutive journals extending from either side of the adjacent end margins of said middle cutting members; said exterior cutting member cutting faces forming two uninterrupted rows of cutting teeth extending along the entire length of each middle cutting member; at least two parallel rows of cutting teeth being provided at any location along the length of the saw blade; said middle cutting members being deeper than said exterior cutting members to provide middle cutting member bearing faces which project beyond the depth of said exterior cutting members; each said deeper middle cutting member adapted for being disposed in a peripheral slot of a saw blade support with said middle cutting member bearing face slidably abutting the bottom of the slot and with said exterior cutting members being disposed alongside said middle cutting members.

* * * * *